US007207824B1

(12) United States Patent
Schumacher et al.

(10) Patent No.: US 7,207,824 B1
(45) Date of Patent: Apr. 24, 2007

(54) ELECTRICAL CONNECTOR WITH QUICK RELEASE MEANS

(75) Inventors: Ralf Schumacher, Lemgo (DE); Jürgen Ziemke, Detmold (DE)

(73) Assignee: Weidmuller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 11/518,804

(22) Filed: Sep. 11, 2006

(30) Foreign Application Priority Data

Oct. 19, 2005 (DE) ..... 20 2005 016 343 U

(51) Int. Cl.
*H01R 13/627* (2006.01)

(52) U.S. Cl. ..... 439/352; 439/357

(58) Field of Classification Search ..... 439/352, 439/353, 357, 358
See application file for complete search history.

(56) References Cited

U.S. PATENT DOCUMENTS 5,314,345 A * 5/1994 Cahaly et al. ..... 439/188
6,699,059 B2 * 3/2004 Nagamine et al. ..... 439/352
6,780,042 B1 * 8/2004 Badescu et al. ..... 439/352
7,108,540 B2 * 9/2006 Annecke ..... 439/352
7,121,867 B2 * 10/2006 Annecke ..... 439/352

FOREIGN PATENT DOCUMENTS

DE 44 41 274 C1 10/1995
DE 44 39 852 A1 5/1996
EP 0 915 534 B1 5/1999

* cited by examiner

*Primary Examiner*—Thanh-Tam Le
(74) *Attorney, Agent, or Firm*—Lawrence E. Laubscher, Sr.; Lawrence E. Laubscher, Jr.

(57) ABSTRACT

An electrical plug connector arrangement includes a male plug member that is normally locked in engagement with a female socket member by a plurality of radially inwardly directed spring fingers that engage the threads of an externally threaded portion of the plug member, together with an annular quick-release member that is axially displaceable relative to the socket member to release the spring fingers from the threads on the plug member, thereby to permit separation of the plug and socket members.

13 Claims, 2 Drawing Sheets

ELECTRICAL CONNECTOR WITH QUICK RELEASE MEANS

BACKGROUND OF THE INVENTION

1. Field of the Invention

An electrical plug connector arrangement includes a male plug member that is normally locked in engagement with a female socket member by a plurality of radially inwardly directed spring fingers that engage the threads of an externally threaded portion of the plug member, together with an annular quick-release member that is axially displaceable relative to the socket member to release the spring fingers from the threads on the plug member, thereby to permit separation of the plug and socket members.

2. Description of Related Art

Plug and socket connectors, for example, of the so-called "M" standard (M6, M8 or M12) are well known in the prior art. They possess the disadvantage that, owing to the screw thread connections between the components, a relatively long time is required to connect and to disconnect the components.

As evidenced by the European patent No. EP 0 915 534 B1, it has been proposed in the patented prior art to provide means for locking together a pair of electrically connected connector components, together with release means for unlocking the locking means.

The present invention was developed to provide an improved quick-fastening and quick-releasing plug connector arrangement. An electrical plug-in connection is provided that displays the following: A plug part with an outer screw thread and a socket part corresponding therewith include a catch means in the form of at least one or several spring fingers that can be pivoted outwardly with respect to the center axis of the counter piece and that, in the plugged-together state of the plug connection, are used for engagement in the outer screw thread of the plug part. A quick-release means is provided that is made as an axially movable release ring, which is so designed and arranged that, with its help, one can release at least one spring finger out of its locking position.

The spring finger makes sure that the two plug connector parts are to be pushed together merely in an axial manner in order to be connected with each other. The release ring guarantees fast unlocking action, preferably by a sliding movement alone. Preferably, the release ring is cheap and is done in a simple fashion in the form of a circular ring disc that displays a tube piece, which extends axially from the inside of the circular ring disc into the seat of the socket part.

Particularly good handling results from the feature that the annular quick-release member on the socket member includes an operating flange portion that extends radially outwardly beyond the plug member, thereby to permit either manual or mechanical release operation.

Preferably, the retaining means is made by stamping and bending from a resilient metal material.

SUMMARY OF THE INVENTION

Accordingly, a primary object of the present invention is to provide a plug connector arrangement wherein the plug and socket members are locked together by the cooperation between a plurality of radially inwardly biased spring fingers carried by the socket member that engage screw threads on the outer circumferential surface of the axially inserted plug member. An annular quick-release member carried by the socket member concentrically about the plug member is axially displaceable to displace the spring fingers radially outwardly of the screw threads, thereby to unlock the plug member for axial removal from the socket member.

According to a more specific object of the invention, the plug member is sectional and includes a body section formed of a suitable electrically insulating synthetic plastic material and having a cylindrical end portion that extends within the socket chamber, together with an externally threaded annular section that is formed of metal and is arranged concentrically around the body cylindrical end portion. The socket member contains a cylindrical chamber within which is concentrically mounted a retaining sleeve that carries at one end remote from the chamber bottom wall a plurality of circumferentially arranged radially inwardly directed downwardly inclined spring fingers that normally extend into locking engagement with the screw threads on the outer surface of the plug member. When the annular release member is axially displaced—either manually or mechanically—in the direction of the socket chamber bottom wall, the spring fingers are disengaged from the screw threads. Corresponding retaining ribs on the annular release member and on the annular displacement limiting means prevent separation of the release member from the socket member.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1:
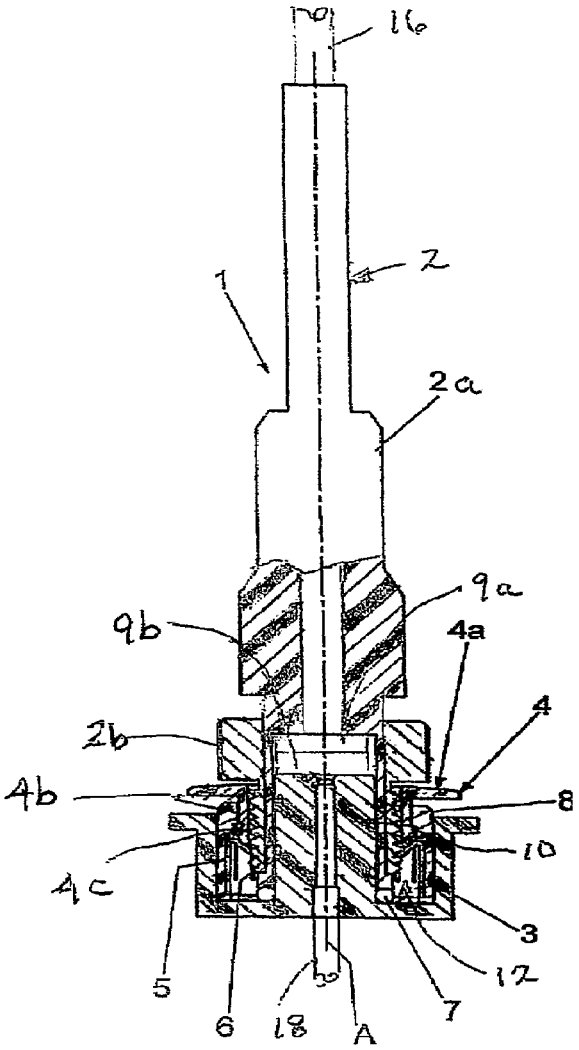
FIG. 1 is a longitudinal sectional view of the plug and socket arrangement of the present invention when in the fully assembled locked condition.
Figure 2:
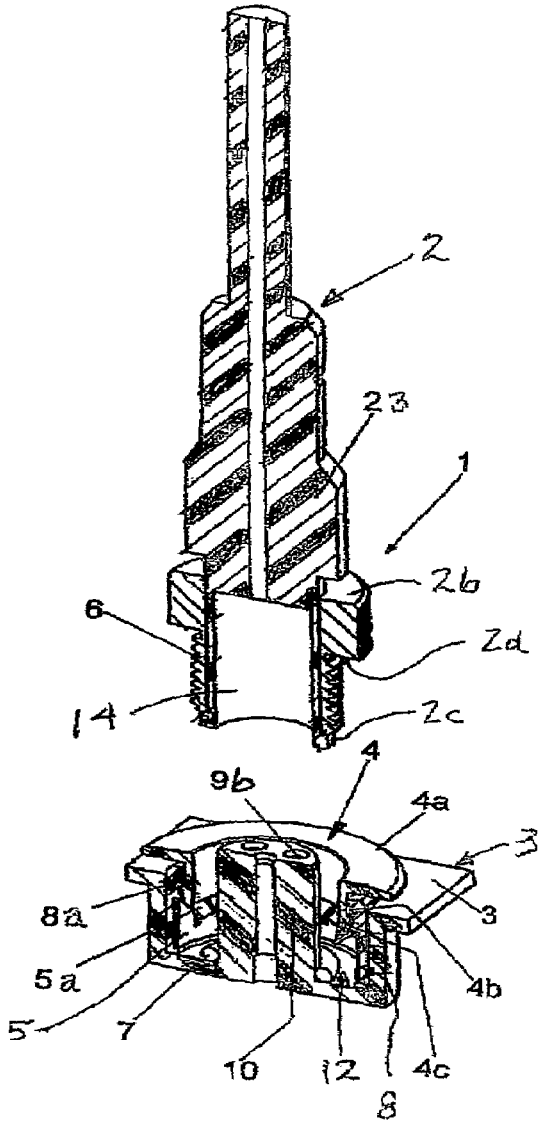
FIG. 2 is a perspective sectional view of the apparatus of FIG. 1 when in the disassembled condition.
Figure 3:
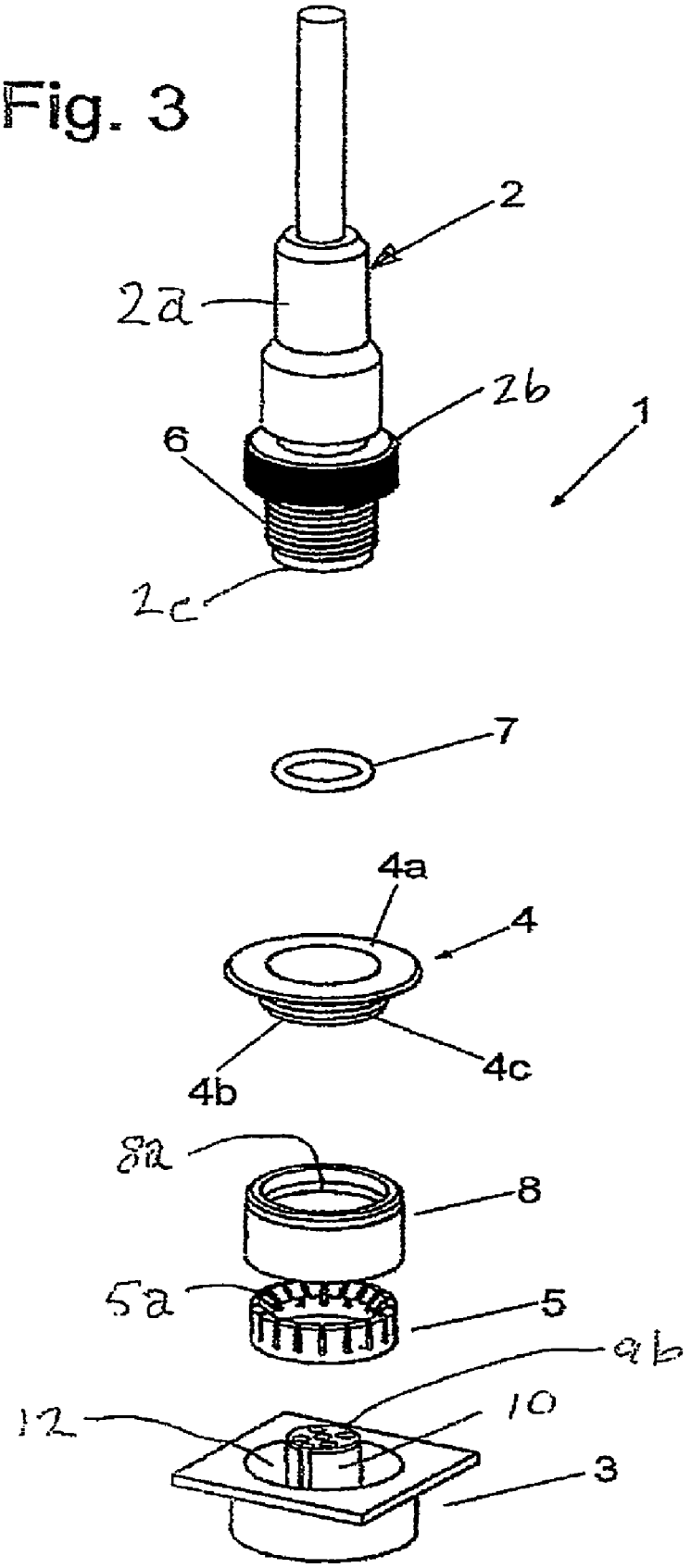
FIG. 3 is an exploded view of the apparatus of FIG. 1.

Referring first more particularly to FIGS. 1 and 2, the plug connector arrangement 1 of the present invention includes a vertical plug member 2 having a body portion 2*a* formed of synthetic plastic material, and an annular externally threaded sleeve portion 2*b* that is formed of metal and is concentrically mounted about a cylindrical first end portion of the plug body portion 2*a*. Associated with the plug member 2 is a colinearly-arranged socket member 3 having an upper surface 3*a* that contains an annular chamber 12 which defines an upwardly projecting central socket portion 10. Mounted concentrically within and seated on the bottom wall of the socket chamber 12 is a tubular displacement limiting member 8 within which is concentrically mounted a metal retaining sleeve 5. At its upper end, the retraining sleeve 5 includes a plurality of radially inwardly directed spring fingers 5*a* that engage screw threads 6 provided on the outer circumferential surface of the threaded sleeve portion 2*b* of the plug member 2. These retaining fingers 5*a* are angularly inclined downwardly toward the chamber bottom wall at an acute angle relative to the longitudinal axis of the retaining sleeve 5.

As best shown in FIG. 2, the plug member 2 contains at its lower first end a bore 14 that receives the socket central projecting portion 10 when the first plug end is inserted fully within the annular chamber 12 contained in the socket member 3. An O-ring 7 is mounted concentrically about the upwardly projecting portion 12 in engagement with the bottom wall of the annular chamber 12, thereby to serve as a resilient stop that spaces the bottom extremity of the plug member 2 from the bottom wall of the chamber, as shown in FIG. 1. Concentrically arranged within the upper end of the tubular displacement limiting member 8 is an annular quick-release member 4 having a tubular body portion 4*b* that terminates at its upper end in a radially outwardly directed annular flange portion 4*a*. At its lower end, the quick-release member includes on its outer surface an annular retaining rib 4*c*. The quick-release member 4 is axially displaceable vertically relative to the displacement limiting member 8, the upward vertical displacement of the quick-release member 4 being limited by an internal rib 8*a* on the displacement limiting member that is arranged to engage the external retaining rib 4*c* on the quick-release member, as best shown in FIG. 2. As shown in FIG. 1, the lower extremity of the annular quick-release member 4 is adapted to engage the radially inwardly directed spring fingers 5*a* provided at the upper end of the retaining sleeve 5. Thus, when the extremities of the spring fingers 5*a* engage the screw threads 6 on the outer circumferential surface of the socket threaded sleeve portion 2*b*, the plug portion 2*b* is locked against vertical displacement relative to the retaining sleeve 5 and the socket member 3. The plug body portion 2*a*, the socket member 3 and the quick-release member 4 are each formed from a suitable electrically insulating synthetic plastic material, and the plug threaded sleeve portion 2*b* is formed from a suitable hard metallic material. The retaining sleeve 5 is preferably formed by bending and punching from a sheet of resilient metal material, such as spring steel.

Electrical conductors 16 extend longitudinally through the plug body portion 2*a* for connection with plug contact means 9*a* arranged within the plug bore 14. Similarly, conductors 18 extend upwardly through the socket member 3 for connection with the socket contact means 9*b*. The plug contacts 9*b* are shown in FIG. 2 as being female contacts arranged for engagement with corresponding male contacts (not shown) on the plug member. The central projecting portion 10 of the socket cooperates with the wall of the plug bore 14 to accurately position the plug within the socket chamber, thereby to assure the desired locking and unlocking operation.

Operation

In operation, when the lower first end of the plug member 2 is inserted axially downwardly in a quick-fastening manner within the annular chamber 12 contained in the socket member 3, the lower extremity of the plug body portion 2*a* engages the O-ring stop 7, thereby to compress the same against the bottom wall of the annular chamber 12. During this downward insertion of the plug member 2, the spring fingers 5 on the retaining sleeve 5 are brought into ratcheting engagement with the external threads 6 on the metal sleeve portion 2*b* of the plug. When the plug is fully inserted into the socket chamber, owing to the downward angular inclination of the spring fingers 5*a*, the extremities of the spring fingers engage the threads of the plug portion 2*b* to lock the plug and socket members together, thereby to maintain the plug contacts 9*a* in engagement with the corresponding socket contacts 9*b*.

In order to disengage the interlocked plug and socket components, the user pushes downwardly on the portion of the annular flange 4*b* that extends outwardly from the quick-release member 4 beyond the plug portion 2*b*, whereupon the lower extremity of the quick-release member 4 displaces the spring fingers 5*a* outwardly from engagement with the screw threads 6 on the outer surface of the retaining sleeve 5. The plug member 2 is thus released for upward displacement relative to the socket member 3, as shown in FIG. 2.

It should be mentioned that the retaining sleeve 5 is retained at its upper and lower ends against vertical displacement within the socket member by internal rib means provided on the internal surface of the displacement limiting member 8. Similarly, the internal rib 8*a* on the displacement limiting member 8 cooperates with the external rib 4*c* on the quick-release member 4 to retain the same against removal relative to the socket member 3.

As indicated previously, the O-ring serves as a stop against which the lower extremity of the plug member 2 abuts when the plug member is fully inserted within the socket chamber 12. The flange portion 4*a* of the quick-release member 4 extends outwardly from the plug threaded sleeve portion 2*b*, thereby to permit either manual operation of the quick-release member, or operation by means of a screwdriver or like under limited space conditions. The flange portion 4*a* also cooperates with the lower surface 2*d* of the plug portion 2*b*, thereby to serve as a stop during insertion of the plug within the socket chamber.

While in accordance with the provisions of the Patent Statutes the preferred forms and embodiments of the invention have been illustrated and described, it will be apparent to those skilled in the art that changes may be made without deviating from the invention described above.

What is claimed is:

1. A quick-release plug connector arrangement, comprising:

(a) a female socket member (3) having a first end surface (3*a*) containing a cylindrical chamber (12) having a bottom wall;

(b) a plug member (2) having a cylindrical first end portion inserted axially within said chamber, said plug member first end portion being externally threaded to define a plurality of screw threads (6);

(c) retaining means normally retaining said plug member first end portion within said chamber, said retaining means including a plurality of radially inwardly directed spring fingers (5*a*) supported circumferentially within said chamber about said plug member first end portion, said spring fingers being biased inwardly toward locking engagement at their free extremities with said plug member external screw threads (6); and (d) quick-release means (4) for releasing said spring fingers from locking engagement with said screw threads, thereby to permit separation of said plug member from said socket member.

2. A quick-release plug connector arrangement as defined in claim 1, wherein said retaining means includes a resilient metal tubular retaining sleeve (5) mounted in said chamber in concentrically spaced relation about said plug first end portion, said retaining sleeve having a first end that is remote from said chamber bottom wall, said spring fingers being integral with said retaining sleeve one end and extending radially inwardly at an acute angle relative to said retaining sleeve first end in the direction of said chamber bottom wall.

3. A quick-release plug connector arrangement as defined in claim 2, wherein said quick-release means includes an annular quick-release member (4) arranged concentrically about said plug member first end portion for relative axial displacement between an inoperable first position remote from said spring fingers, and an operable second position in which said spring fingers are displaced radially outwardly toward disengaged positions relative to said plug member external screw threads, thereby to permit axial separation of said plug and socket members.

4. A quick-release plug connector arrangement as defined in claim 3, wherein said quick-release member includes an annular operating flange portion (4*a*) that extends radially outwardly beyond said plug member.

5. A quick-release plug connector arrangement as defined in claim 3, and further including displacement limiting means (8) limiting the extent of axial displacement of said quick-release member relative to said socket member in the direction of said inoperable position.

6. A quick-release plug connector arrangement as defined in claim 5, wherein said displacement limiting means includes an annular displacement limiting member (8) mounted in said chamber concentrically about said retaining sleeve, said displacement limiting member having a first internal annular stop rib (8*a*); and further wherein said annular quick-release member includes on its outer circumferential surface an annular external stop rib (4*c*) that is arranged for engagement with said internal stop rib.

7. A quick-release plug connector arrangement as defined in claim 6, and further including second internal rib means on said displacement limiting member preventing axial displacement of said retaining sleeve relative to said displacement limiting member.

8. A quick-release plug connector arrangement as defined in claim 2, wherein said retaining sleeve (5) is formed by stamping and bending a resilient sheet formed of metal.

9. A quick-release plug connector arrangement as defined in claim 8, wherein said plug member is sectional and includes a body section (2*a*) formed from an electrically-insulating synthetic plastic material, said body section having a cylindrical outer surface adjacent said plug member first end portion, and an annular section (2*b*) formed from metal arranged concentrically about said body section cylindrical outer surface, the external circumferential surface of said annular section being externally threaded to define said external screw threads (6).

10. A quick-release plug connector arrangement as defined in claim 9, wherein the plug body section includes adjacent the extremity of said plug member first end portion an external annular retaining rib (2*c*) that retains said plug annular section on said plug body section.

11. A quick-release plug arrangement as defined in claim 1, wherein said chamber is annular, thereby to define a central socket portion (10), said central socket portion projecting outwardly beyond said socket first end surface; and further wherein said plug member first end contains an axial bore (14) that receives said projecting central socket portion when said plug member first end portion is inserted into said chamber.

12. A quick-release plug connector arrangement as defined in claim 11, and further including a resilient O-ring mounted concentrically about said central projecting portion, said O-ring being compressed between said chamber bottom wall and the end extremity of said plug member first end portion.

13. A quick-release plug connector arrangement as defined in claim 11, and further including a plurality of plug electrical contacts (9*a*) mounted in said plug axial bore, and a plurality of socket electrical contacts (9*b*) arranged on said central projecting portion for engagement with said plug electrical contacts, respectively.

* * * * *